US007026934B2

(12) United States Patent
Soto et al.

(10) Patent No.: US 7,026,934 B2
(45) Date of Patent: Apr. 11, 2006

(54) METHOD AND APPARATUS TO PREVENT UNAUTHORIZED REMOVAL OF A PEDESTAL FROM A BASE

(75) Inventors: Manuel A. Soto, Lake Worth, FL (US); Adam Bergman, Boca Raton, FL (US); Guillermo Padula, Boca Raton, FL (US); Thomas G. Riley, Lake Worth, FL (US); Jackie J. Cooper, Boynton Beach, FL (US); Ricci S. Cerasini, Plantation, FL (US); Israel Alexander, Pompano Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 10/698,165

(22) Filed: Oct. 31, 2003

(65) Prior Publication Data

US 2005/0093710 A1 May 5, 2005

(51) Int. Cl.
*G08B 13/12* (2006.01)

(52) U.S. Cl. ..... 340/568.2; 340/572.7; 340/652; 235/435

(58) Field of Classification Search ..... 340/568.2, 340/568.8, 571, 568.1, 572.1, 568.3
See application file for complete search history.

(56) References Cited

U.S. PATENT DOCUMENTS

| | | | | |
|---|---|---|---|---|
| 2,643,372 | A * | 6/1953 | Stelter | 340/545.6 |
| 4,274,088 | A * | 6/1981 | Pierson et al. | 340/568.8 |
| 4,418,336 | A * | 11/1983 | Taylor | 340/571 |
| 4,994,793 | A * | 2/1991 | Curtis | 340/666 |
| 5,353,011 | A * | 10/1994 | Wheeler et al. | 340/572.4 |
| 5,748,085 | A * | 5/1998 | Davis et al. | 340/572.1 |
| 6,177,876 | B1 * | 1/2001 | Krueger | 340/666 |
| 6,686,841 | B1 * | 2/2004 | Busch et al. | 340/571 |
| 2005/0040232 | A1 * | 2/2005 | Maloney | 235/385 |

* cited by examiner

*Primary Examiner*—Benjamin C. Lee

(57) ABSTRACT

A method and apparatus to prevent unauthorized removal of a pedestal from a base are described.

15 Claims, 4 Drawing Sheets

400

METHOD AND APPARATUS TO PREVENT UNAUTHORIZED REMOVAL OF A PEDESTAL FROM A BASE

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

Typically, the interrogation zone is created between a pair of antenna pedestals. Each antenna pedestal may be mounted to a base. Removing a pedestal from a base may disrupt the interrogation zone, and thus affect the capability of the EAS system to detect tagged items within the interrogation zone. Consequently, there may be need for improvements in securing a pedestal to a base in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
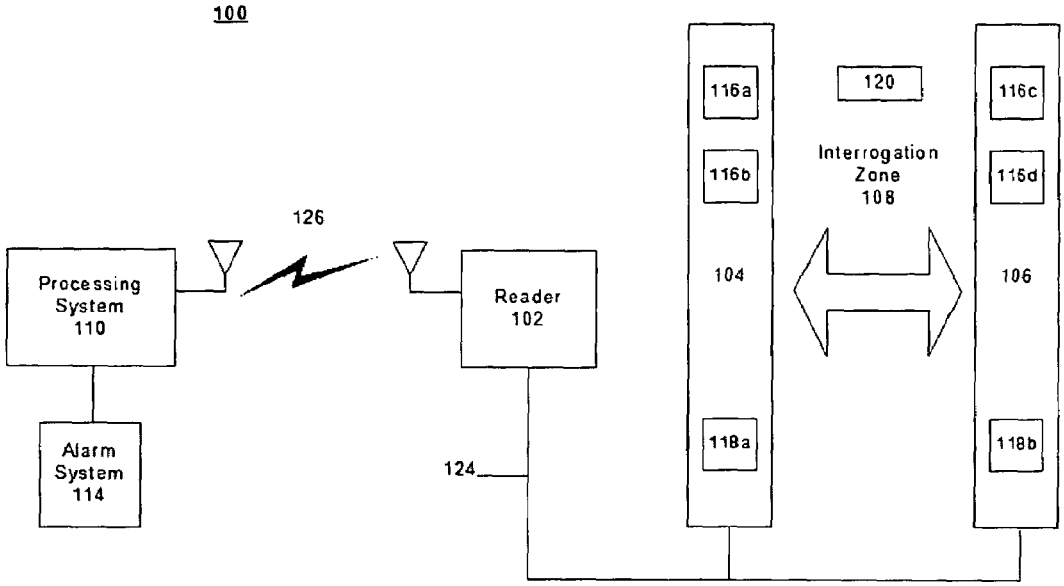
FIG. 1 illustrates an EAS system suitable for practicing one embodiment.

Referring now in detail to the drawings wherein like parts are designated by like reference numerals throughout, there is illustrated in FIG. 1 a system suitable for practicing one embodiment. FIG. 1 illustrates an EAS system 100. Although FIG. 1 describes a particular EAS system, it may be appreciated that the embodiments may operate with any EAS system using a pedestal system as modified using the principles discussed herein.

In one embodiment, EAS system 100 may comprise EAS detection equipment, including a reader system 102 connected to a pedestal system via a communications medium 124. The pedestal system may comprise a pair of antenna pedestals, such as antenna pedestals 104 and 106, for example. The EAS detection equipment may be installed at an exit point of a controlled area, such as a retail store, for example.

In one embodiment, the EAS detection equipment may be used to create an interrogation zone 108 between antenna pedestals 104 and 106, for example. The interrogation zone may comprise an area receiving interrogation signals from reader system 102 via antennas 116*a–d* and 118*a–b* embedded within antenna pedestals 104 and 106. The interrogation signals may trigger a response from a security tag, such as security tag 120. The anti-theft functionality of EAS system 100 may be implemented through the interrogation and response interaction between reader system 102 and security tag 120.

In one embodiment, security tag 120 may comprise one or more RF antennas and a sensor. The sensor may be any sensor that emits a detectable signal when in interrogation zone 108. The sensor may comprise, for example, a RF sensor, a Radio-Frequency Identification (RFID) sensor, an acoustically resonant magnetic EAS sensor, a magnetic EAS sensor, and so forth. The embodiments are not limited with respect to the type of sensor used for security tag 120 as long as it emits a detectable signal at the proper frequencies. The embodiments are not limited in this context.

In one embodiment, security tag 120 may be designed to attach to an item to be monitored. Examples of tagged items may include an article of clothing, a Digital Video Disc (DVD) or Compact Disc (CD) jewel case, a movie rental container, packaging material, and so forth. The embodiments are not limited in this context.

In general operation, security tag 120 may enter interrogation zone 108 and receive a plurality of interrogation signals from reader system 102. Security tag 120 may receive the interrogation signals, and radiate a signal in response to the interrogation signals. The signal may be received by reader system 102. Reader system 102 may determine whether to trigger an alarm based on the received signal.

In one embodiment, EAS system 100 may comprise a reader system 102. Reader system 102 may be configured to create an interrogation zone 108 between antenna pedestals 104 and 106 via the embedded antennas. Reader system 102 may also be configured to detect the presence of security tag 120 within interrogation zone 108. Once security tag 120 is within interrogation zone 108, reader system 102 may determine whether to send an alarm signal to an alarm system, such as alarm system 114.

In one embodiment, reader system 102 may also operate as a data reader and writer for an RFID chip. Reader system 102 may interrogate and read a RFID chip included in security tag 120, if any. Reader system 102 may also write data into the RFID chip. This may be accomplished using any wireless communication link between reader system 102 and security tag 120, for example.

In one embodiment, EAS system 100 may comprise a processing system 110. Processing system 110 may comprise any device having a general purpose or dedicated processor, machine-readable memory and computer program segments stored in the memory to be executed by the processor. An example of a processing system may include a computer, server, personal digital assistant, switch, router, laptop, cell phone and so forth. Processing system 110 may be used to store and execute application programs, such as an alarm control system, inventory control system, and so forth. The inventor control system, for example, may track information such as merchandise identification, inventory, pricing, and other data. Processing system 110 may also be configured with the appropriate hardware and/or software to function as an RFID reader, similar to reader system 102. This may be useful for implementing inventory tracking functionality and anti-theft functionality of EAS system 100, as desired for a given implementation.

In one embodiment, processing system 10 may be in communication with reader system 102 via a communication link 124. In one embodiment, communication link 124 may comprise a communication link over a wireless communication medium. The wireless communication medium may comprise one or more frequencies from the RF spectrum, for example. Communication link 124 may also represent a communication link over a wired communications medium as well. The wired communications medium may comprise twisted-pair wire, co-axial cable, Ethernet cables, and so forth. The embodiments for the communication link are not limited in this context.

In one embodiment, EAS system 100 may comprise an alarm system 114. Alarm system 114 may comprise any type of alarm system to provide an alarm in response to an alarm signal. The alarm signal may be received from any number of EAS components, such as processing system 110, reader system 102, or a monitoring module as discussed in more detail with reference to FIG. 3. Alarm system 114 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

Figure 2:
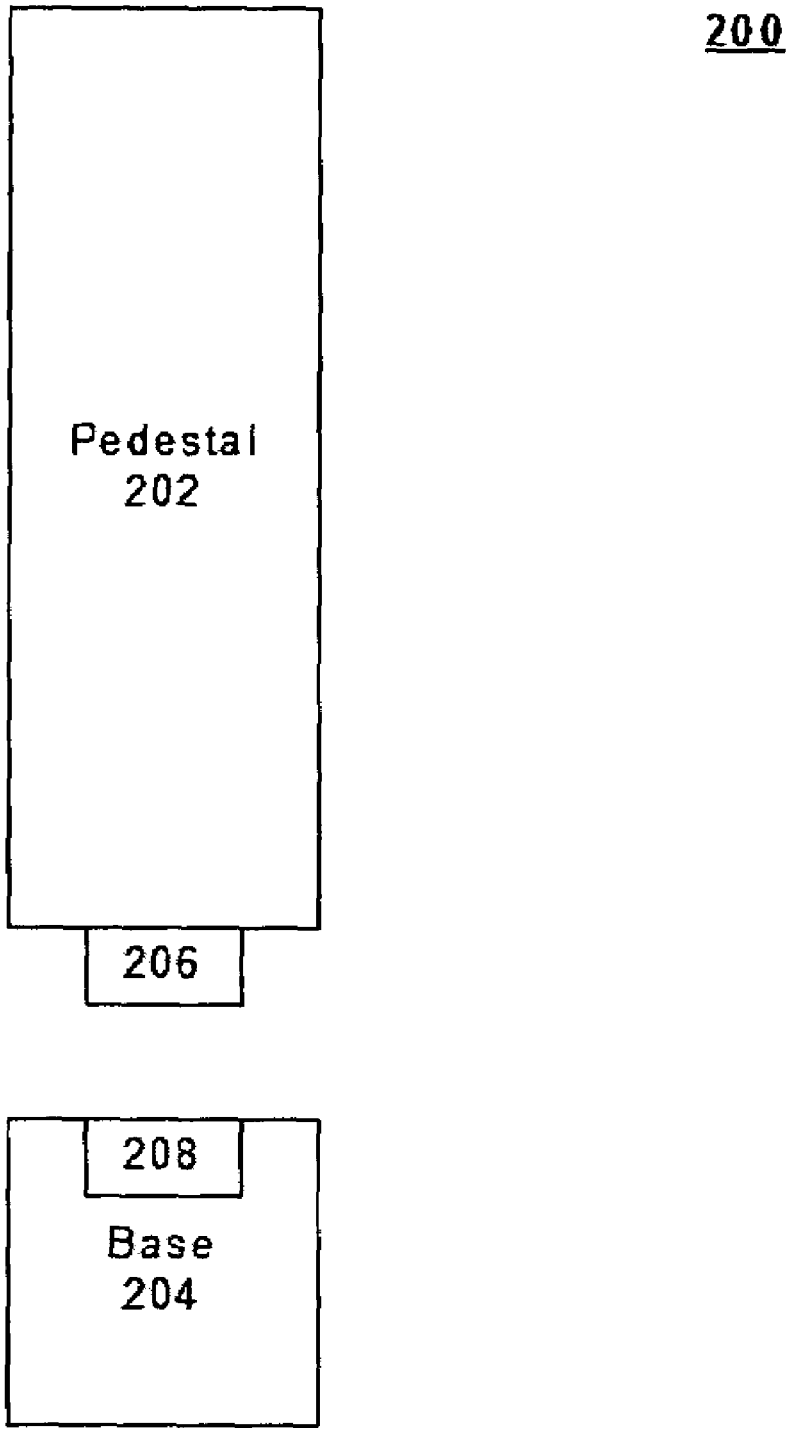
FIG. 2 illustrates a pedestal system in accordance with one embodiment.

FIG. 2 illustrates a pedestal system in accordance with one embodiment. FIG. 2 illustrates a pedestal system 200. Pedestal system 200 may be representative of, for example, antenna pedestals 104 and 106. An example of pedestal system 200 may comprise a pedestal system made by Sensormatic® Corporation, as modified using the principles discussed in the various embodiments. The type of pedestal system is not limited in this context.

As shown in FIG. 2, pedestal system 200 may comprise a pedestal 202 and a base 204. Pedestal 202 may further comprise a connector 206. Base 204 may further comprise a connector 208. Pedestal 202 may be designed to be attached and detached from base 204 via connectors 206 and 208. Connectors 206 and 208 may be designed to physically interlock when joined. The interlocking mechanism may be sufficient to prevent accidental disconnects of pedestal 202 from base 204, but may allow pedestal 202 from being intentionally lifted off of base 204. For example, connector 206 may be a male connector comprising a metal bracket that is fastened to pedestal 202, and connector 208 may be a female connector also comprising a metal bracket fastened to base 204. During the attachment operation, connector 206 may be inserted into connector 208, thereby forming pedestal 202 and base 204 into a single pedestal unit. Connectors 206 and 208 may be designed to self-align during the attachment operation. During the detachment operation, connector 206 may be withdrawn from connector 208, thereby converting the single pedestal unit back into its component parts. The type of physical connectors is not limited in this embodiment.

In one embodiment, connectors 206 and 208 may also be configured to complete a communications connection between pedestal 202 and base 204. The communications connection may be completed using a communications medium. The term "communications medium" as used herein may refer to any medium capable of carrying information signals. Examples of communications mediums may include metal leads, wires, semiconductor material, twisted-pair wire, co-axial cable, fiber optic, radio frequencies (RF) and so forth. The terms "connection" or "interconnection," and variations thereof, in this context may refer to physical connections and/or logical connections.

The information signals may represent information carried by an electrical, optical or acoustic signal. In one embodiment, for example, the communication medium may be metal wires carrying electrical signals. This embodiment may be discussed in more detail with reference to FIG. 3.

Figure 3:
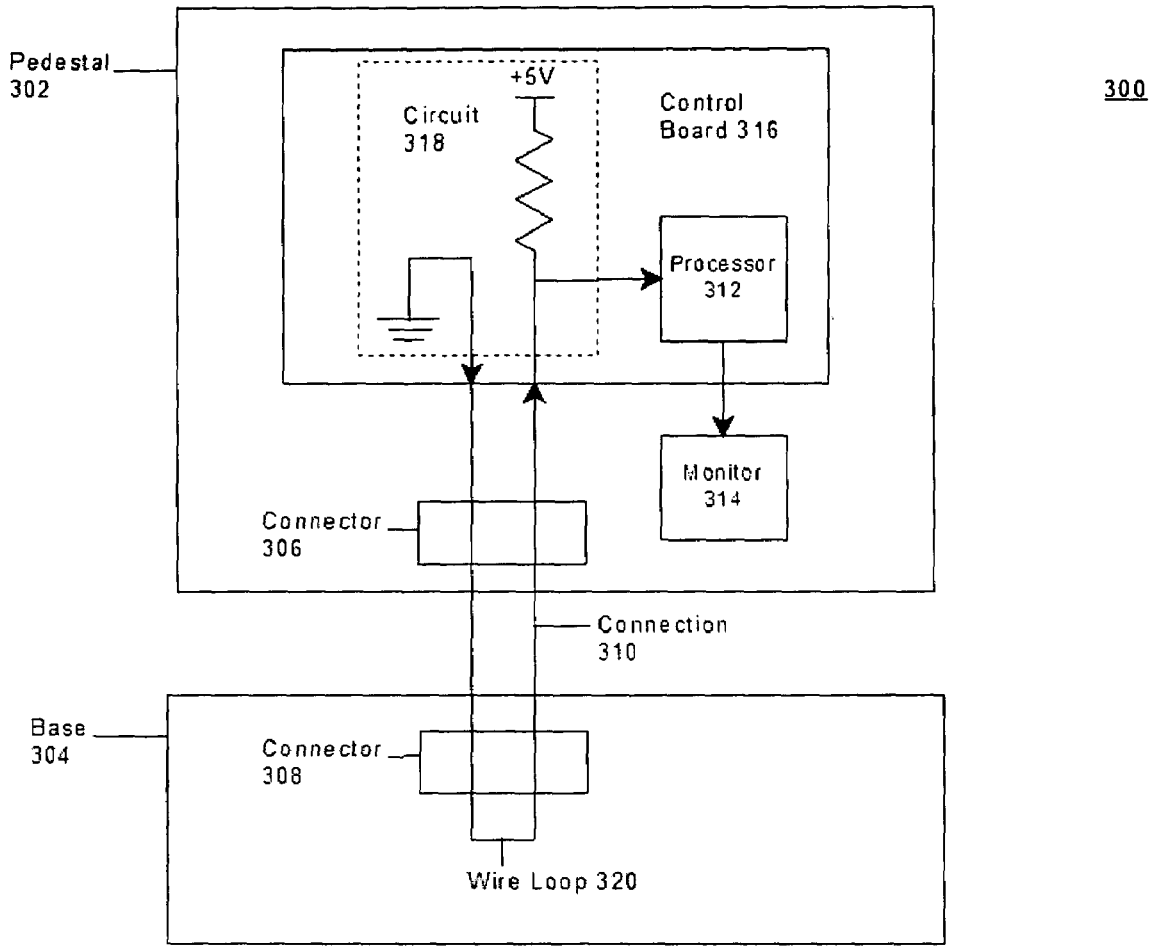
FIG. 3 illustrates a block diagram of an alarm subsystem in accordance with one embodiment.

FIG. 3 illustrates a block diagram of an alarm subsystem in accordance with one embodiment. FIG. 3 illustrates an alarm subsystem 300. Alarm subsystem 300 may comprise one or more modules. Although the embodiment has been described in terms of "modules" to facilitate description, one or more circuits, components, registers, processors, software subroutines, or any combination thereof could be substituted for one, several, or all of the modules.

In one embodiment, alarm subsystem 300 may comprise a plurality of components, with some components physically located with pedestal 202, base 204 and/or alarm system 114. Although alarm subsystem 300 is shown with a limited number of components for purposes of clarity, it can be appreciated that the functionality of alarm subsystem 300 may be implemented with any number of components and still fall within the scope of the embodiments.

In one embodiment, alarm subsystem 300 may comprise a pedestal 302 and base 304. Pedestal 302 and base 304 may be representative of, for example, pedestal 202 and base 204, respectively. Pedestal 302 may further comprise a control board 316, a monitor 314, and a connector 306. Base 304 may further comprise a connector 308 and a wire loop 320.

In one embodiment, pedestal 302 may comprise a control board 316. Control board 316 may include a processor 312. Further control board 316 may further include a circuit 318. Circuit 318 may be used to form a ground connection 310 with connector 308 of base 304. A controller cable may be used to supply ground connection 310 from control board 316 to a connector 306. Connector 308 of base 304 may include wire loop 320 to interconnect both wires from the controller cable and return the ground signal to circuit 318 of control board 316. Although control board 316 is shown as separate from reader system 102, it can be appreciated that control board 316 and reader system 102 may be combined as desired for a particular implementation. In this embodiment, reader system 102 may be housed within antenna pedestal 302, for example.

In one embodiment, pedestal 302 may comprise a monitor 314. Monitor 314 may be configured to monitor ground connection 310 between pedestal 302 and base 304. If pedestal 302 is removed from base 304, the ground return signal will be disconnected. Monitor may detect the disconnection via, for example, a signal from processor 312 of control board 316. Monitor 314 may generate an alarm signal in response to the detected disconnect. Monitor 314 may forward the alarm signal to an alarm system, such as alarm system 114.

In one embodiment, alarm system 114 may receive the alarm signal, and generate an alarm in response to the alarm signal. As described previously, examples of the alarm may comprise an audible alarm such as a siren or bell, a visual alarm such as flashing lights, or a silent alarm. The embodiments are not limited in this context.

The operations of systems 100–300 may be further described with reference to FIG. 4 and accompanying examples. Although FIG. 4 as presented herein may include a particular programming logic, it can be appreciated that the programming logic merely provides an example of how the general functionality described herein can be implemented. Further, the given programming logic does not necessarily have to be executed in the order presented unless otherwise indicated. In addition, although the given programming logic may be described herein as being implemented in the above-referenced modules, it can be appreciated that the programming logic may be implemented anywhere within the system and still fall within the scope of the embodiments.

Figure 4:
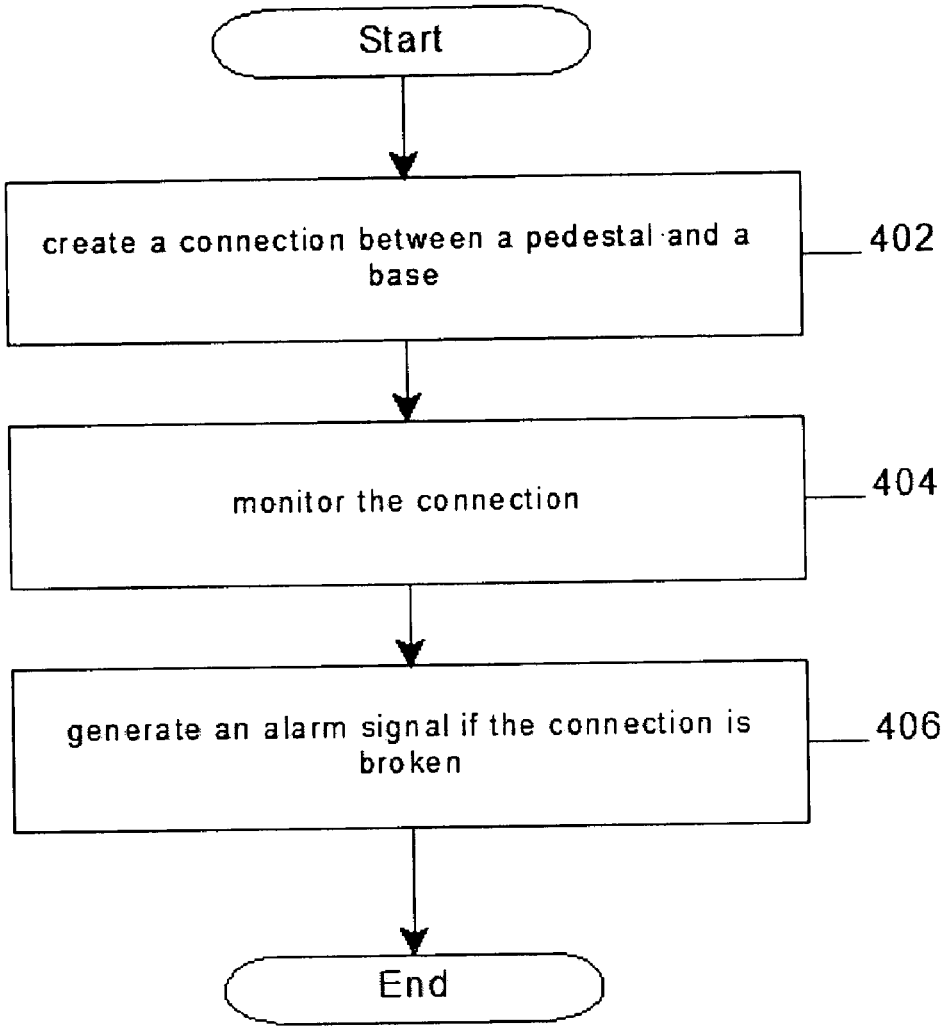
FIG. 4 illustrates a block flow diagram of the programming logic performed by an alarm subsystem in accordance with one embodiment.

FIG. 4 illustrates a block flow diagram of the programming logic performed by an alarm subsystem in accordance with one embodiment. FIG. 4 illustrates a programming logic 400 for an alarm subsystem, such as alarm subsystem 300, for example. As shown in programming logic 400, a connection may be created between a pedestal and a base at block 402. The connection may comprise, for example, a ground connection. The connection may be monitored at block 404. An alarm signal may be generated if the connection is broken at block 406. The connection may be broken by, for example, removing pedestal 302 from base 304.

In one embodiment, monitor 314 may generate the alarm signal. Monitor 314 may send the alarm signal to an alarm system, such as alarm system 114. Alarm system 114 may receive the alarm signal. Alarm system 114 may generate an alarm in response to the alarm signal. The type of alarm may be preconfigured using the user interface for alarm system 114.

In one embodiment, pedestal 302 may be reinserted into base 304. In this event, the connection may be reestablished between pedestal 302 and base 304. Monitor 314 may detect the connection and may stop sending the alarm signal to alarm system 114. In this case, alarm system 114 may be configured to activate the alarm for the duration that the alarm signal is received from monitor 314, or deactivated by an external command via the user interface. Monitor 314 may also be configured to send a cease alarm signal to alarm system 114. In this case, alarm system 114 may be configured to active the alarm in response to the alarm signal, and deactivate the alarm in response to the cease alarm signal or an external command via the user interface.

The embodiments may be implemented using an architecture that may vary in accordance with any number of factors, such as desired computational rate, power levels, heat tolerances, processing cycle budget, input data rates, output data rates, memory resources, data bus speeds and other performance constraints. For example, one embodiment may be implemented using software executed by a processor. The processor may be a general-purpose or dedicated processor, such as a processor made by Intel® Corporation, for example. The software may comprise computer program code segments, programming logic, instructions or data. The software may be stored on a medium accessible by a machine, computer or other processing system. Examples of acceptable mediums may include computer-readable mediums such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, one embodiment may be implemented as dedicated hardware, such as an Application Specific Integrated Circuit (ASIC), Programmable Logic Device (PLD) or Digital Signal Processor (DSP) and accompanying hardware structures. In yet another example, one embodiment may be implemented by any combination of programmed general-purpose computer components and custom hardware components. The embodiments are not limited in this context.

While certain features of the embodiments have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A method, comprising:

creating a connection between a pedestal and a base, said pedestal to create an interrogation zone for interrogating one or more security tags;

monitoring said connection; and generating an alarm signal if said connection is broken.

2. The method of claim 1, further comprising:

sending said alarm signal to an alarm system;

receiving said alarm signal at said alarm system; and generating an alarm in response to said alarm signal.

3. The method of claim 2, wherein said alarm comprises at least one of an audio alarm, visual alarm and silent alarm to represent unauthorized removal of said pedestal from said base.

4. The method of claim 1, wherein said connection is a ground connection.

5. The method of claim 1, wherein said generating comprises:

removing said pedestal from said base; and breaking said connection in accordance with said removal.

6. The method of claim 5, further comprising:

detecting that said connection has been created;

sending a cease alarm signal to an alarm unit.

7. An apparatus, comprising:

a pedestal to create an interrogation zone for interrogating one or more security tags;

a base to couple to said pedestal; and an alarm subsystem to generate an alarm signal if said pedestal is removed from said base.

8. The apparatus of claim 7, wherein said alarm subsystem comprises:

a circuit to create a connection between said pedestal and said base; and a monitor to monitor said connection and generate said alarm signal if said connection is broken.

9. The apparatus of claim 7, further comprising an alarm system to communicate with said alarm subsystem, said alarm system to receive said alarm signal and generate an alarm in response to said alarm signal.

10. The apparatus of claim 7, wherein said pedestal further comprises an antenna to communicate radio-frequency signals to create said interrogation zone.

11. The apparatus of claim 7, wherein said base further comprises a reader system to communicate interrogation signals to an antenna.

12. The apparatus of claim 7, further comprising a security tag to communicate with a radio-frequency reader system.

13. An article comprising:

a storage medium;

said storage medium including stored instructions that, when executed by a processor, result in creating a connection between a pedestal and a base, monitoring said connection, and generating an alarm signal if said connection is broken, wherein said pedestal is to create an interrogation zone for interrogating one or more security tags.

14. The article of claim 13, wherein the stored instructions, when executed by a processor, further result in sending said alarm signal to an alarm generator, receiving said alarm signal at said alarm generator, and generating an alarm in response to said alarm signal.

15. The article of claim 13, wherein the stored instructions, when executed by a processor, further result in said generating by removing said pedestal from said base, and breaking said connection in accordance with said removal.

* * * * *